US007114299B2

(12) United States Patent
Ringness

(10) Patent No.: US 7,114,299 B2
(45) Date of Patent: Oct. 3, 2006

(54) GLASS BLOCK FRAME

(75) Inventor: Jeffrey A. Ringness, Irving, TX (US)

(73) Assignee: Acme Services Company, LLP, Forth Worth, TX (US)

( * ) Notice: Subject to any disclaimer, the term of this patent is extended or adjusted under 35 U.S.C. 154(b) by 413 days.

(21) Appl. No.: 10/701,743

(22) Filed: Nov. 4, 2003

(65) Prior Publication Data

US 2005/0102931 A1 May 19, 2005

(51) Int. Cl.
*E06B 1/04* (2006.01)

(52) U.S. Cl. ..... 52/204.1; 52/204.53; 52/656.5; 52/204.7; 52/308

(58) Field of Classification Search ..... 52/456, 52/656.5, DIG. 17, 306, 307, 308, 204.1, 52/204.53, 204.7; D25/60
See application file for complete search history.

(56) References Cited

U.S. PATENT DOCUMENTS 4,831,804 A * 5/1989 Sayer ..... 52/475.1
4,891,925 A 1/1990 Carlson et al.
4,924,649 A 5/1990 Taylor
4,999,964 A 3/1991 Taylor
5,003,744 A 4/1991 Taylor
5,014,471 A * 5/1991 Ballstadt ..... 52/98
5,031,372 A * 7/1991 McCluer ..... 52/307
5,042,210 A 8/1991 Taylor
5,115,610 A * 5/1992 Kessler ..... 52/204.591
5,218,806 A 6/1993 Taylor
5,687,521 A 11/1997 Carlson et al.
D402,535 S * 12/1998 Wright ..... D8/354
5,904,018 A * 5/1999 Campagnari ..... 52/306
5,904,020 A 5/1999 Carlson et al.
6,427,399 B1 8/2002 Ross et al.
D513,966 S * 1/2006 Wright ..... D8/354

* cited by examiner

*Primary Examiner*—Naoko Slack
*Assistant Examiner*—Jessica Laux
(74) *Attorney, Agent, or Firm*—Gardere Wynne Sewell, LLP

(57) ABSTRACT

Glass block windows or walls are formed by a frame characterized by perimeter members which may be secured to each other at adjacent corners by chemical or thermal bonding or by mechanical connector members. The perimeter members include inner and outer walls, at least one lateral glass block retaining flange and opposed recesses for receiving releasable retainer members which have a hook part which may be snap fitted into the recesses and retained by reentrant edges of the recesses. Block spacer members are formed by opposed block support wall or body parts and by opposed lateral end parts which receive snap-in block retainer and trim strips.

24 Claims, 8 Drawing Sheets

GLASS BLOCK FRAME

BACKGROUND

Glass block windows or walls have enjoyed popularity in residential and commercial buildings for many years. Glass blocks present a unique problem in building construction in that installing glass blocks in the same manner as conventional masonry is time consuming and such blocks are difficult to install in a manner which is aesthetically pleasing. Accordingly, there have been previous efforts to develop pre-fabricated frames which are adapted to support glass blocks whereby glass block windows or an entire wall or partition may be built using such pre-fabricated frame members. Thus, conventional masonry construction may be avoided and, if necessary, individual glass blocks may be replaced if broken or chipped without requiring replacement of an entire wall or without the difficulty of replacing one or two glass blocks which may have been damaged in a masonry glass block wall.

Although prior efforts have been made to provide modular glass block frames or grids there have been several long sought improvements which include providing frame components which are easily fabricated and lend themselves to easy fabrication of various sizes of frames, whereby the frames may be built for various combinations of blocks or grids in a timely manner and at low cost. In this regard it is often desirable to use frame components that may be extruded of extrudable materials, particularly plastic.

There have been several needs in the art of glass block frames which have not been previously met and it is to these ends that the present invention has been developed.

SUMMARY OF THE INVENTION

The present invention provides an improved glass block frame for fabricating glass block windows or glass block walls.

In accordance with one aspect of the present invention a glass block frame is provided with perimeter members which may be easily fabricated to form a generally rectangular or square glass block window or wall, which perimeter members may be conveniently connected to selected different types of block retainer members and to glass blocks spacers thereby forming a grid of glass blocks for a window or wall.

In accordance with a further aspect of the present invention, a glass block frame is provided which includes perimeter members which may be connected to selected types of retainers or trim parts including a sill extension part. Each of the retainers, trim parts and sill extension parts are conveniently snap fittable into engagement with a perimeter member as well as cooperating glass block spacer members. The perimeter members, spacer members, trim and retainer members and sill extension members are all conveniently formed as plastic extrusions or the like.

Still further, the perimeter members of the present invention may be formed to accommodate corner brace members or the perimeter members may be formed for securement to each other at intersecting corners by chemical or thermal bonding.

In accordance with yet another aspect of the present invention, glass block frames are provided which may be secured to each other by respective connector members which may also be snap fitted into recesses on opposite sides of the perimeter members utilizing the same features which are adapted to engage various retainer members. Still further, the perimeter members are configured to retain a sealant for sealing the perimeter edges of glass blocks to improve weathertightness for exterior glass block windows and the like.

The aforementioned advantages and superior features of the glass block frame and selected components therefor in accordance with the invention will be further appreciated, together with other important aspects thereof, upon reading the detailed description which follows in conjunction with the drawings.

DETAILED DESCRIPTION OF THE PREFERRED EMBODIMENTS

Figure 1:
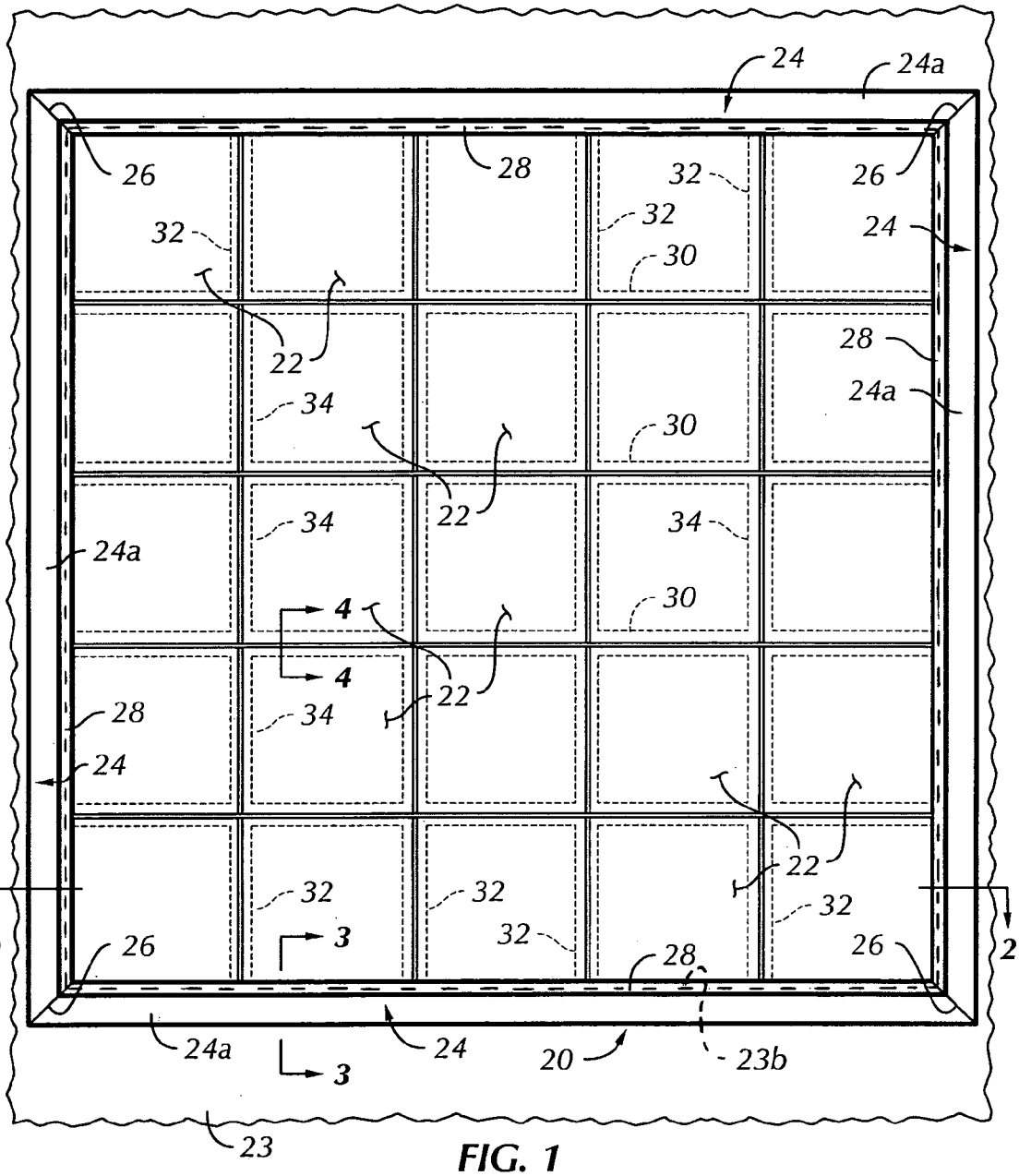
FIG. 1 is an elevation of a glass block frame in accordance with the present invention.

In the description which follows like parts and portions of parts may be marked throughout the specification and drawing with the same reference numerals, respectively. The drawing figures are not necessarily to scale.

Figure 2:
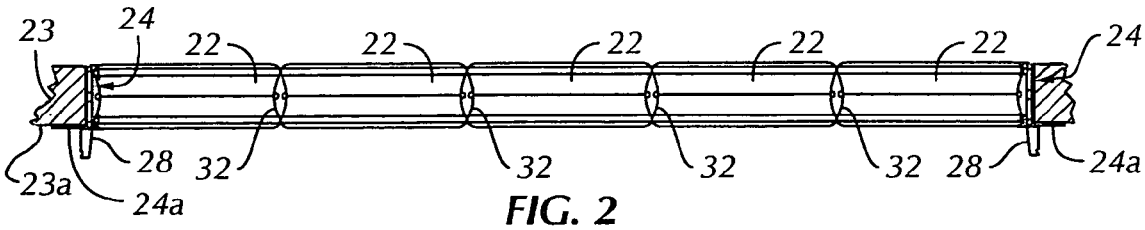
FIG. 2 is a section view taken generally along the line 2—2 of FIG. 1.

Referring to FIGS. 1 and 2, there is illustrated a glass block frame in accordance with the invention and generally designated by the numeral 20. The frame 20 is characterized as a generally square grid of glass blocks 22 which are mounted in frame 20 to form a window in a wall 23 in an opening 23*b* thereof, or to form part of or an entire wall itself.

The glass block frame 20 comprises a perimeter part made up of plural perimeter members 24 which are secured to each other at mitered corner joints 26 by chemically or thermally bonding the perimeter members 24 to each other or by connecting perimeter members similar to the members 24 together in accordance with the invention and to be described further herein. The perimeter members 24 are each provided with a depending external flange 24*a*, see FIG. 2, also, adapted to be mounted contiguous with the external surface 23*a* of wall 23. In the embodiment shown in FIGS. 1 and 2 the frame 20 also is provided with sill extension and perimeter block retainer strips or members 28 removably securable to the perimeter members 24, respectively, and of a configuration to be described further herein.

Referring still further to FIGS. 1 and 2, the frame 20 is provided with a grid formed of spacers between each of the glass blocks for supporting the blocks adjacent to each other and with respect to the perimeter members 24. In a preferred arrangement generally horizontal elongated spacers 30 extend between opposed vertically extending perimeter members 24, viewing FIGS. 1 and 2. Additionally, spacer members 32 extend between top and bottom perimeter members 24 and one of the spacer members 30, respectively, and intermediate spacer members 34 extend between adjacent spacer members 30. The configurations of spacer members of 30, 32 and 34 will be described further herein.

Figure 3:
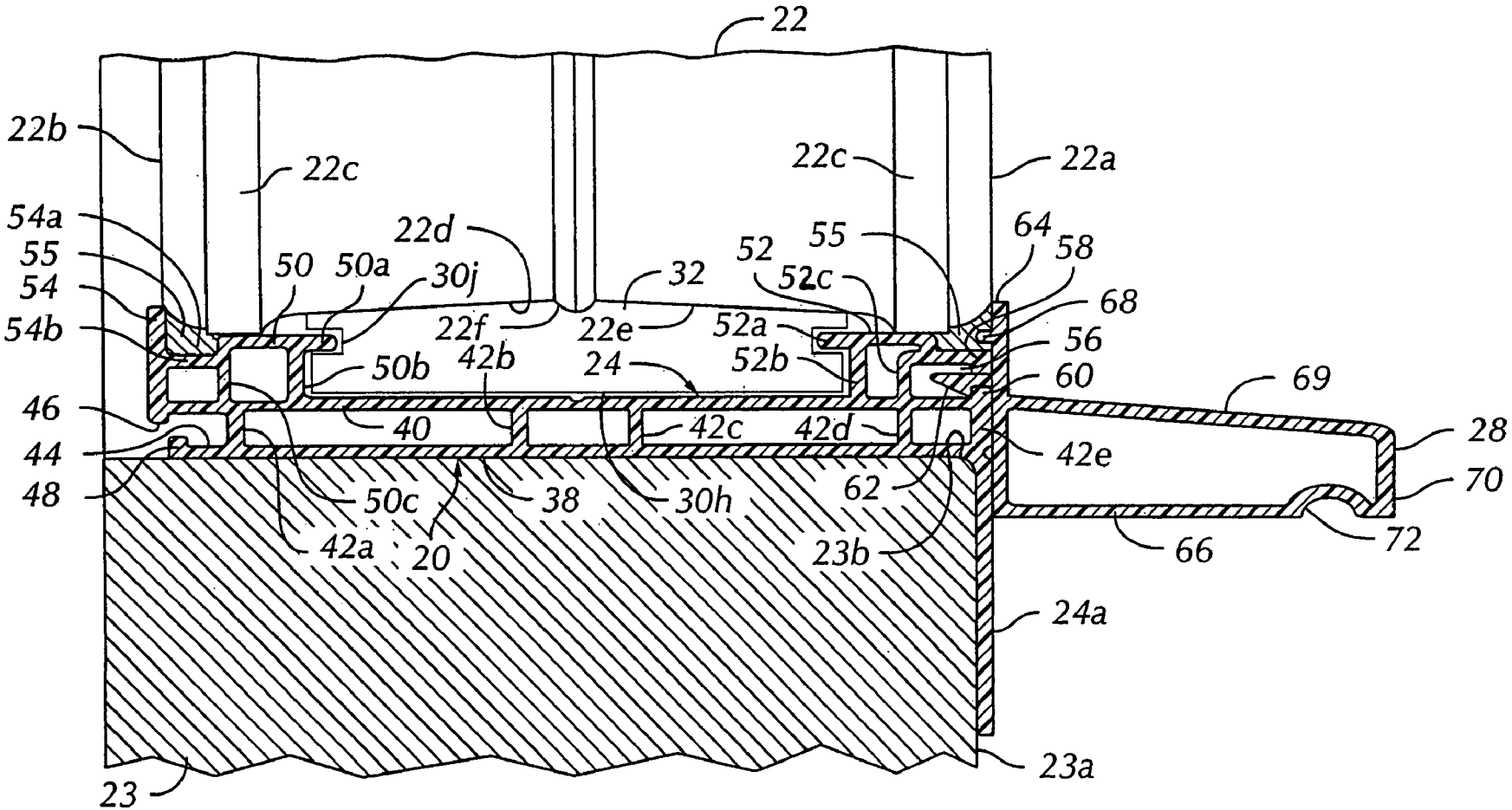
FIG. 3 is a detail section view taken generally along the line 3—3 of FIG. 1.

Referring now to FIG. 3, the general cross-section configuration of one preferred embodiment of a perimeter member for a glass block frame in accordance with the invention is illustrated. As shown in FIG. 3, the perimeter member 24 is adapted to support a glass block 22 having, generally, the configuration illustrated and which is typical of a variety of glass blocks commercially available. Glass block 22 is characterized by opposed faces 22*a* and 22*b* adjacent which perimeter support surfaces 22*c* are formed, are substantially planar in one direction, and extend around the perimeter of the block on opposite sides thereof, as shown. Glass block 22 is also provided with a body portion intermediate the faces 22*a* and 22*b* and delimited by inclined surfaces 22*d* and 22*e* which terminate in a peripheral rib 22*f* substantially centered between the opposed faces 22*a* and 22*b*.

Perimeter member 24 is characterized by a generally planar outer wall 38 and an inner generally planar and parallel wall 40 spaced therefrom and joined to the outer wall by spaced apart webs 42*a*, 42*b*, 42*c*, 42*d* and a web 42*e* which is substantially co-planar with flange 24*a*. Outer and inner walls 38 and 40 terminate at the external or outward facing side of perimeter member 24 at web 42*e* and walls 38 and 40 terminate at the inner facing side of perimeter member 24 to define a recess 44 which is also delimited by reentrant edges 46 and 48 forming hook or retainer flanges for retaining a connector member or members to be described further herein.

Perimeter member 24 is further formed with opposed and substantially co-planar block support wall parts or surfaces 50 and 52, as shown in FIG. 3, which terminate in opposed flanges 50*a* and 52*a*. Webs 50*b* and 50*c* are formed integral with and support the support surface 50 and webs 52*b* and 52*c* are formed integral with and support the support surface 52. Flanges 50*a* and 52*a* project into opposed recesses formed in one end of a spacer 32, as shown in FIG. 3, or one of the spacers 30, as will be described further herein. Supports surfaces 50 and 52 stand off from and are parallel to inner wall 40 to form a clearance space for a fastener head, as shown for an alternate embodiment of perimeter member 24.

The inwardly facing side of perimeter member 24 includes an elongated planar, integral retaining flange 54 engageable with face 22*b* of glass block 22. A suitable sealant 55 may be disposed between the edge of the glass block and a recess 54*a* formed by flange 54 and a web 54*b*, as shown in FIG. 3.

Referring further to FIG. 3, the configuration of perimeter member 24 further includes a recess 56 opening toward the exterior of the perimeter frame 20 and delimited by reentrant edges or hook parts 58 and 60 as shown. As shown in FIG. 3, recess 56 is operable to receive a hook part 62 which projects from a retaining flange 64 of sill and retainer member 28 and extending normal to an outer wall 66 of member 28. A locating nub 68 of sill member 28 extends normal to and from flange 64 into a sealant receiving space formed between the support surface 52 and the flange 64 for receiving a quantity of sealant 55 also to seal the perimeter of a block 22.

Referring still further to FIG. 3, perimeter sill and retainer member 28 is further characterized by an inner wall 69 spaced from outer wall 66 and formed integral with the flange 64. A web 70 joins walls 66 and 69 as shown. An arcuate recess 72 is formed along and in the outer wall 66 of sill and retainer member 28.

Figure 4:
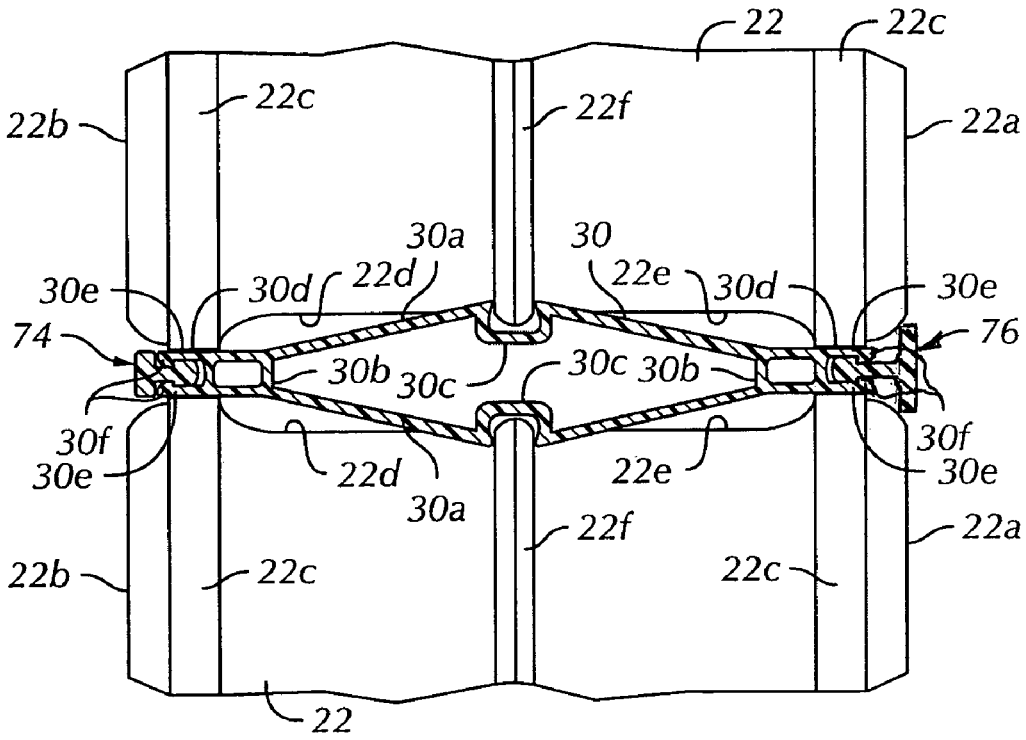
FIG. 4 is a detail section view taken generally along the line 4—4 of FIG. 1.

Referring now to FIG. 4, there is illustrated the cross sectional configuration of one of the spacers 30. The spacers 32 and 34 have the same cross sectional configuration but opposed longitudinal ends of each of the spacers 30, 32 and 34 are configured differently for a purpose to be explained in further detail herein. The spacer 30 is characterized by opposed spaced apart, relatively thin walled support or body parts 30*a* which are inclined with respect to each other, are interconnected by webs 30*b* at opposite ends and are each provided with a midsection 30*c* forming a channel shaped recess for receiving the ribs 22*f* of adjacent glass blocks 22, as illustrated. In the illustration of FIG. 4, there is shown slight interference between the support parts 30*a* and the sloping wails 22*d* and 22*e* of the glass blocks 22. This interference represents the amount of deflection the support parts 30*a* normally undergo when a spacer 30 is disposed between glass blocks, as illustrated. In this way the blocks 22 are firmly engaged with and secured between spacers 30, 32 and 34, or between the spacers and the perimeter members 24.

Referring further to FIG. 4, the spacer 30 includes opposed extension portions 30*d* defining opposed spaced apart parts 30*e*, respectively, which form reentrant edges 30*f* for engaging respective snap-in trim and grid retainer members 74 and 76, as illustrated. The trim and retainer members 74 and 76 are substantially similar but are characterized by flanges of different widths and shank parts of different lengths.

Figure 17:
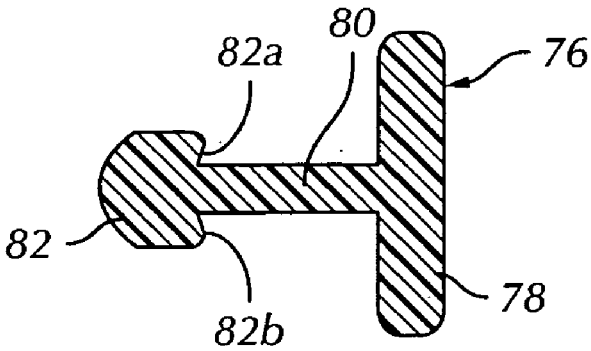
FIG. 17 is a transverse section view of a retainer or trim member as shown in FIGS. 1 and 4, but on a larger scale.

For example, referring briefly to FIG. 17, the retainer member 76 has a configuration similar to the letter T and includes an elongated flange 78 with a depending shank part 80 extending normally from the flange at its mid-point. A slightly bulbous head 82 is formed on the distal end of the shank part 80 and is provided with transverse edges 82*a* and

82*b*, which are operable to engage the reentrant edges 30*f* of the flanges 30*e*, see FIG. 4, to retain the trim and retainer part 76 engaged with spacer 30.

As shown in FIG. 4, the trim and retainer part 74 is of substantially similar geometry except for the length of its shank part and the width of its flange whereby the member 74 primarily forms a cover for the extension parts 30*d* of the spaces 32 and 34, if used. Alternatively, of course, the spacers 30, 32 and 34 which act also as block retainers could be filled with caulking material at the recesses formed between adjacent blocks 22 in place of the trim and/or retainer members 74 and 76, if desired. However, use of the retainer members 76, in particular, is advantageous in that these parts snap-into the recesses defined by the flanges 30*e* of the spacers 30 and aid in retaining the blocks 22 in their normal working positions. However, those skilled in the art will recognize that the spacers 30 also retain the blocks 22 in position by registration of the ribs 22*f* in the recesses formed by the channel portions 30*c* of the spacers.

Figure 5:
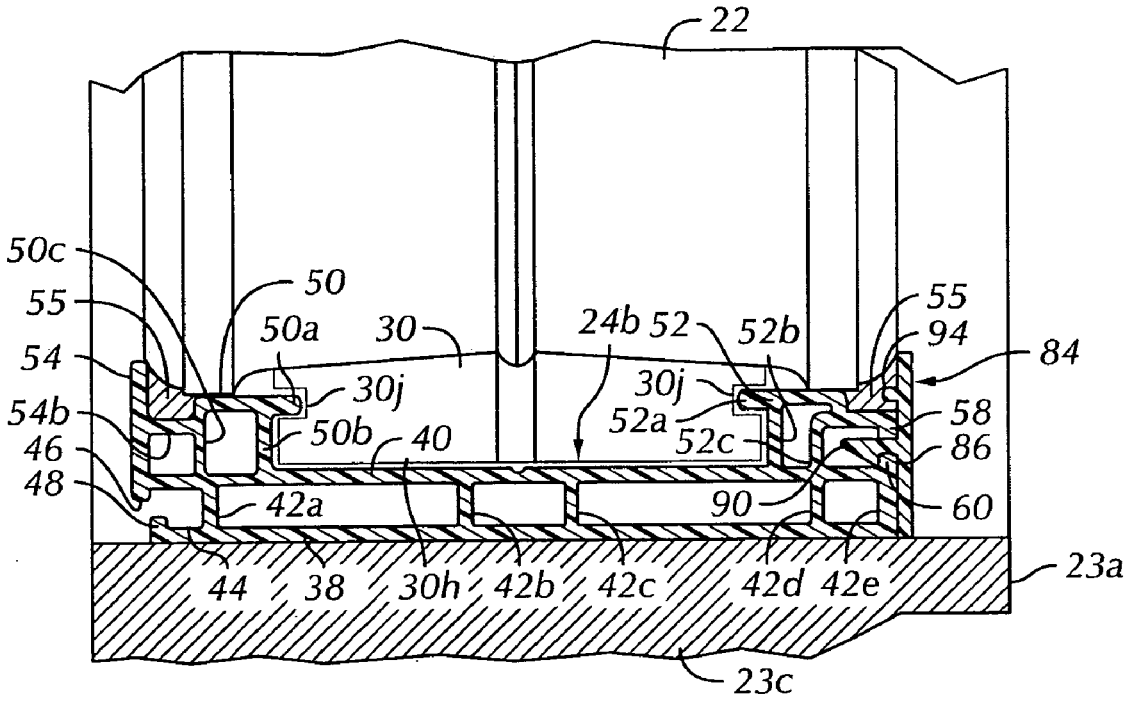
FIG. 5 is a detail section view showing one alternate embodiment of a perimeter member of the present invention.

Referring now to FIG. 5, there is illustrated a modified perimeter member 24*b* which is substantially like the perimeter member 24 except the outer perimeter flange 24*e* has been eliminated. The perimeter member 24*b* is preferred for use with a frame wherein the frame is inset from both sides of a wall, such as wall 23*c* illustrated in FIG. 5. In substantially all other respects the perimeter members 24*b*, for a frame to be inset from both sides of a wall, as shown in FIG. 5, are identical to the perimeter members 24. As further shown in FIG. 5, an elongated snap-in type retainer member 84 is used in conjunction with a perimeter frame using the perimeter members 24*b*, as illustrated.

Figure 16:
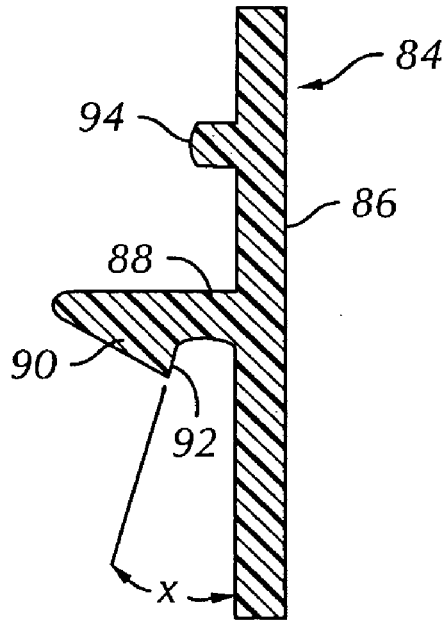
FIG. 16 is a transverse section view of the retainer member shown in FIGS. 5, 14 and 15 on a larger scale.

Referring briefly to FIG. 16 also, the snap-in, removable, perimeter retainer member 84 includes an elongated substantially planar flange 86 and a hook shank 88 extending normally therefrom and including a somewhat tapered or wedge shaped retainer hook part 90 having a width greater than the shank 88 and defining a hook surface 92, inclined with the respect to the plane of the flange 86 at an angle "x" of about thirty degrees, preferably. The geometry of hook part 90 is found on the hook part 62 for retainer and sill extension part 28, as well as on certain other retainer or connector parts in accordance with the invention. The retainer member 84 also includes a locating nub 94 formed on the side of the flange which includes the shank 88. As shown in FIG. 5, retainer member 84 is operable to have its hook part 90 snapped into engagement with reentrant edge 60 of perimeter member 24*b*.

Figure 6:
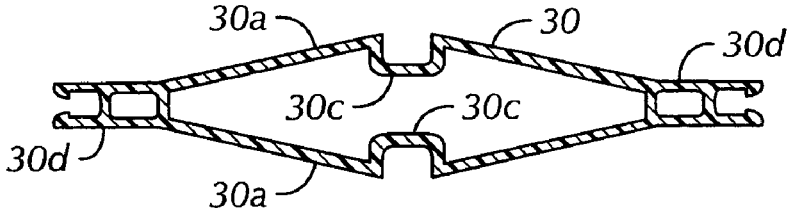
FIG. 6 is a detail transverse section view showing the geometry of a block spacer member in accordance with the invention.
Figure 7:
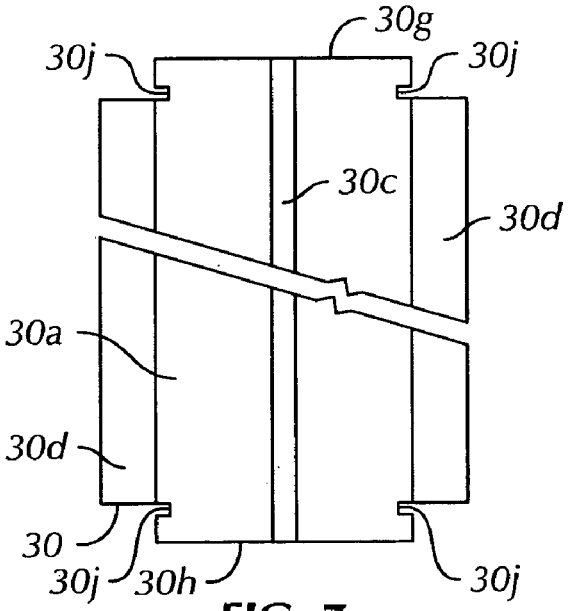
FIG. 7 is a plan view of a spacer member which is connectable at opposite ends to a perimeter member, respectively.

Referring now to FIGS. 6 through 9, the spacer 30 is shown in FIG. 6 including the opposed the elastically deflectable body or support parts 30*a*, the channel portions 30*c* and the opposed flange end parts 30*d*. FIG. 7 is a plan view of the spacer 30 illustrating opposed ends 30*g* and 30*h* which are devoid of the flange end parts 30*d* but are provided with opposed slots 30*j*, respectively, formed in the body wall parts 30*a*. Slots 30*j* are registrable with the opposed flange portions 50*a* and 52*a* of a perimeter part 24 or 24*b*, see FIGS. 3 and 5. In this way the spacers 30 are secured to opposed perimeter parts 24 or 24*b* in a manner which is believed to be understandable to those of ordinary skill in the art.

Figure 8:
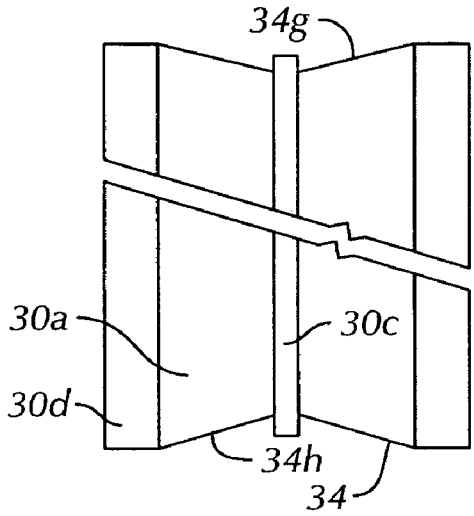
FIG. 8 is a plan view of a spacer member adapted to be disposed between and normal to other spacer members.

Referring briefly to FIG. 8, there is illustrated a plan view of one of the spacers 34. The spacers 34 have the same cross section as spacers 30 and thus some of the same components are indicated by the same reference numbers also, as shown in FIG. 8. However, opposite ends 34*g* and 34*h* of the spacers 34 are cut away, as illustrated, to conform to the cross sectional shape of the body parts 30*a* of a spacer 30 or 32.

Figure 9:
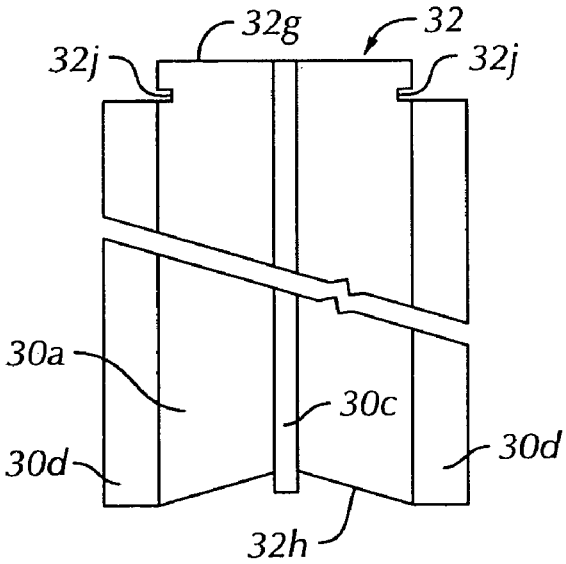
FIG. 9 is a plan view of a spacer member adapted to be connected at one end to a perimeter member and disposed adjacent and normal to another spacer member at its opposite end.

Referring to FIG. 9, a plan view of a spacer 32 illustrates that this spacer 32 has a longitudinal end configuration 32*g* on one end which is provided with opposed slots 32*j* and corresponding to the longitudinal end 30*g* of a spacer 30. The opposite end 32*h* of spacer 32 has a configuration corresponding to that of the ends of a spacer 34 for conforming of the geometry of spacer body parts 30*a*, for example, when abutted against and normal to a spacer 30. As mentioned previously, the transverse cross-sectional configurations of spacers 32 and 34 are identical to that of spacer 30.

Figure 10:
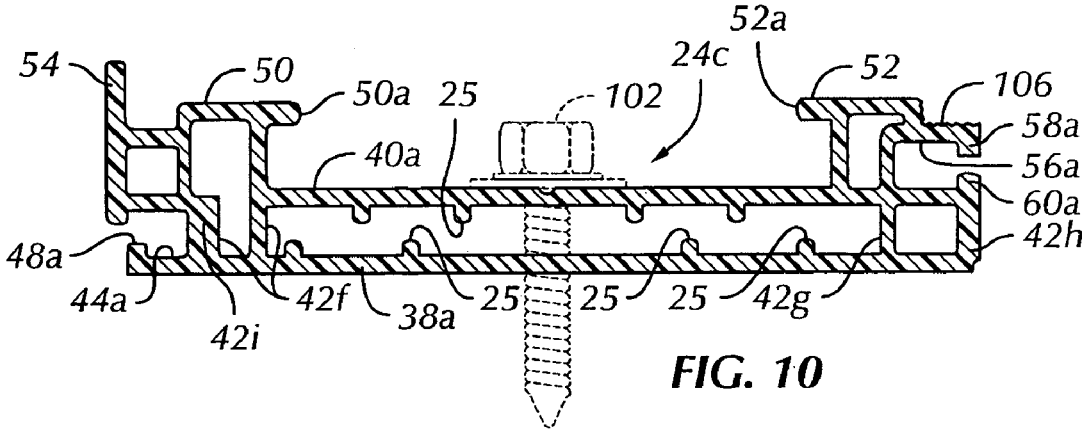
FIG. 10 is a transverse section view of another embodiment of a perimeter member for a glass block frame in accordance with the invention.

Referring now to FIG. 10, another embodiment of a perimeter member in accordance with the invention is illustrated and generally designated by the numeral 24*c*. The perimeter member 24*c* has a configuration similar to the perimeter members 24 and 24*b* in several respects but includes inner and outer walls 38*a* and 40*a* with connecting webs 42*f*, 42*g*, 42*h* and 42*i*, but the centrally located webs corresponding to webs 42*b* and 42*c* have been eliminated. However, standoff bosses 25 are provided on opposed inward facing surfaces of the walls of 38*a* and 40*a*. The perimeter member 24*c* includes glass block support surfaces or wall parts 50 and 52 together with projections or flanges 50*a* and 52*a* for projecting into recesses formed in the ends of the spacers 30 or 32. Perimeter member 24*c* includes a retainer flange 54, a laterally open recess 44*a*, and a reentrant edge 48*a* delimiting recess 44*a*, as shown in FIG. 10. Still further, perimeter member 24*c* includes a recess 56*a*, delimited by reentrant edges or projections 58*a* and 60*a* for receiving a retainer member, such as the retainer member 84.

Figure 11:
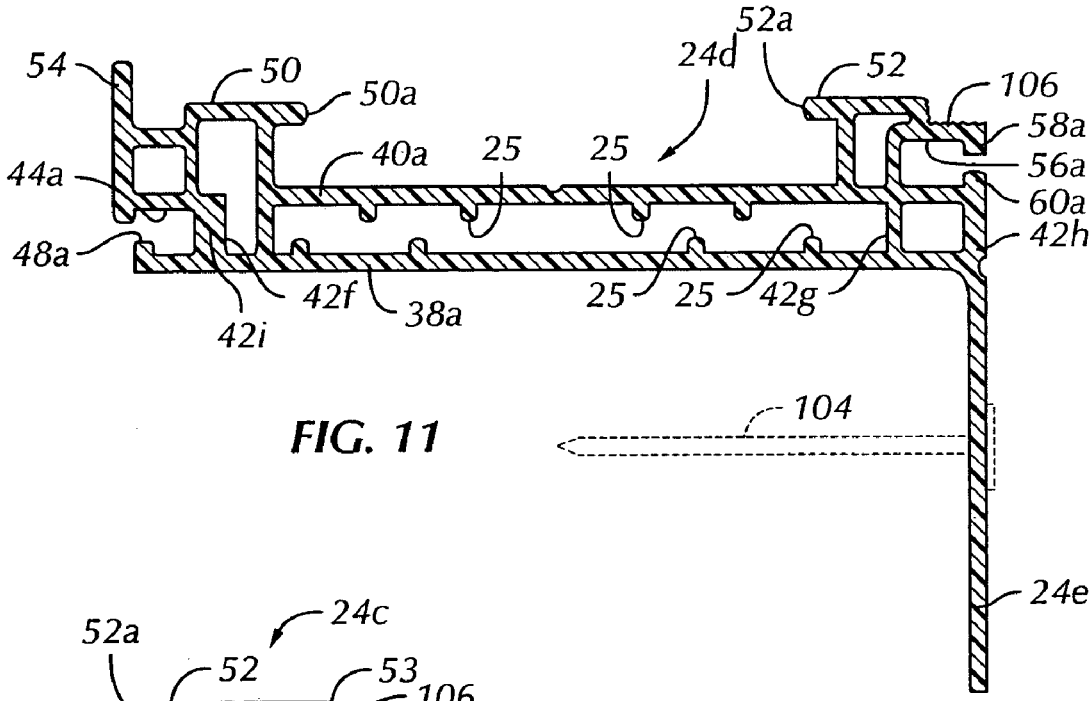
FIG. 11 is a transverse section view of a further alternate embodiment of a perimeter member having an integral flange, in accordance with the invention.
Figure 12:
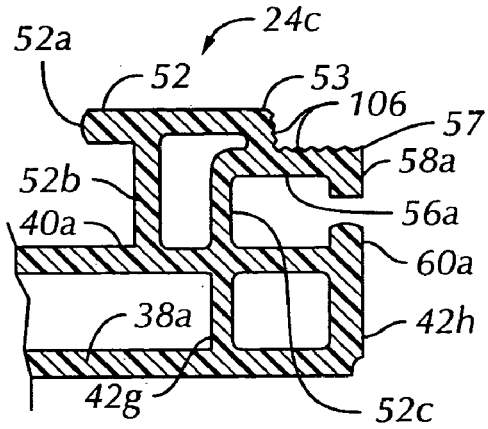
FIG. 12 is a detail section view showing sealant retaining serrations on a perimeter member in accordance with the invention.

Referring to FIG. 11, another embodiment of a perimeter member is illustrated, and generally designated by the numeral 24*d*. Perimeter member 24*d* is substantially like perimeter member 24*c* but includes a depending interior wall flange 24*e* similar to flange 24*a*, FIG. 3. FIGS. 10 and 11 illustrate how the perimeter members 24*c* and 24*d* may be secured to a wall, such as wall 23, using conventional screw fasteners 102 and/or nails 104, respectively. The perimeter members 24*c* and 24*d* each include plural serrations 106, see FIG. 12 also, which are formed on surfaces of intersecting walls 53 and 57 and define a recess for receiving sealant 55, as shown in FIGS. 3 and 5, for the perimeter members 24 and 24*b*. The serrations 106 increase the adhesion of sealant 55 to the perimeter members 24*c* and 24*d*. The serrations 106 are also preferably provided in the same locations for the perimeter members 24 and 24*b*.

Figure 13:
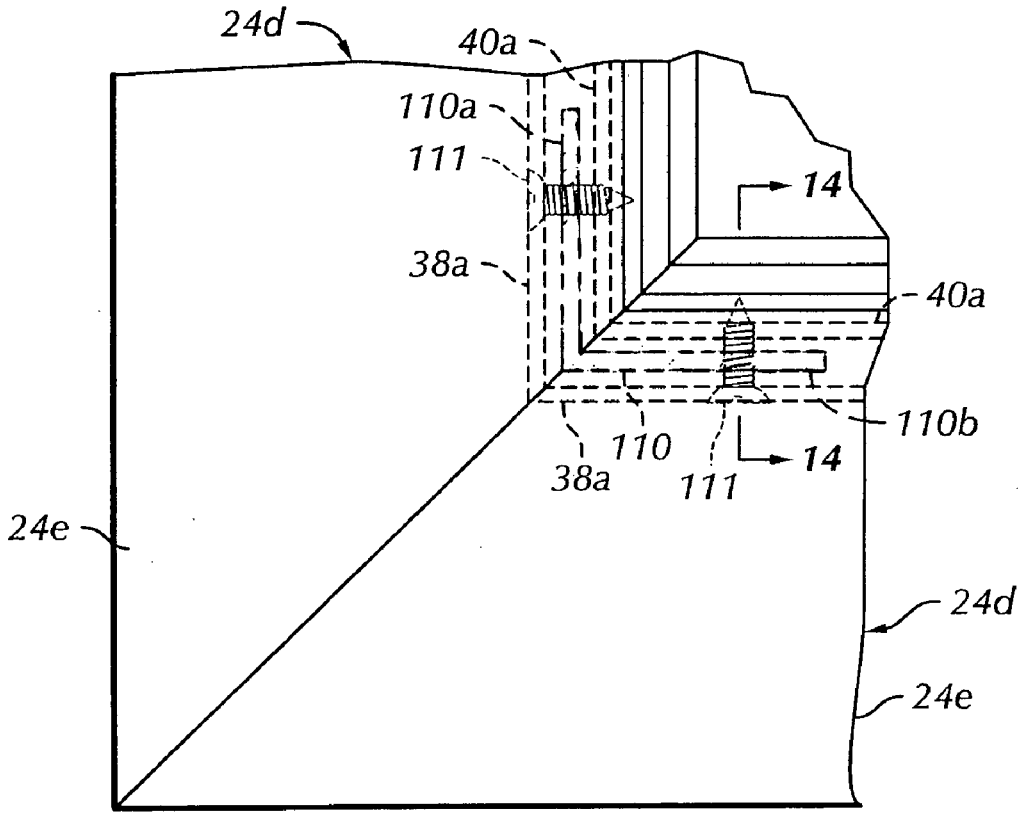
FIG. 13 is a detail view showing a corner connector for the embodiments of the perimeter members shown in FIGS. 10 and 11.
Figure 14:
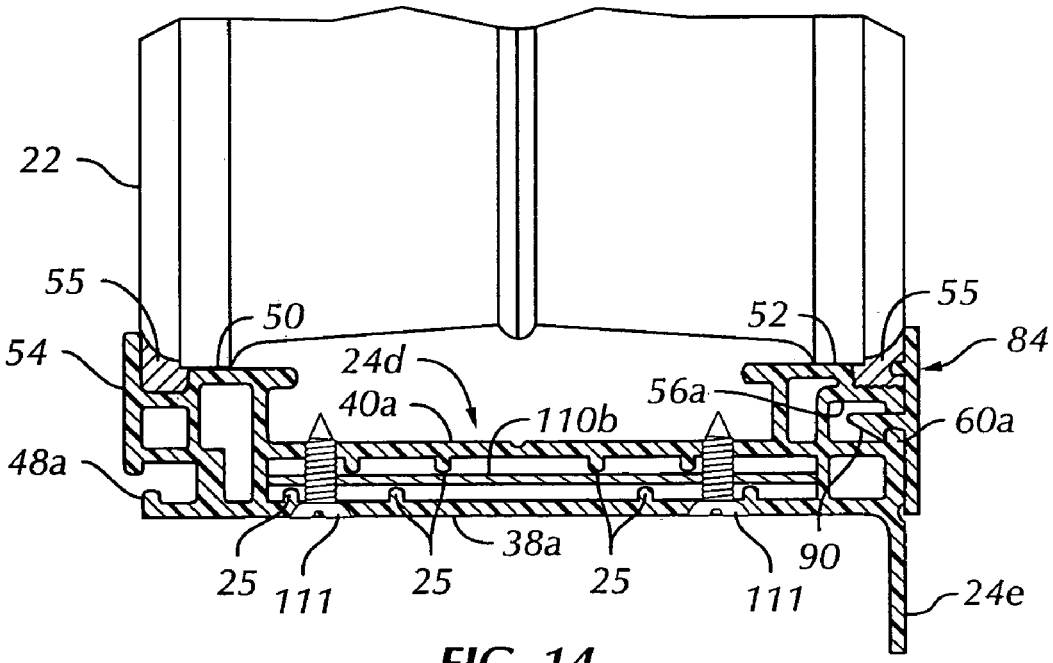
FIG. 14 is a transverse section view of the corner connection shown in FIG. 13 and taken generally from the line 14—14 of FIG. 13.

Referring now to FIGS. 13 and 14, the perimeter members 24*c* or 24*d* may be mitered at their opposite ends and connected at the corners of a frame, generally in the same manner as the perimeter members 24 or 24*b* may be connected to form frames, such as the frame 20. Two perimeter members 24*d* are shown interconnected in FIGS. 13 and 14 by way of example. However, the perimeter members 24*c* and 24*d* may utilize a mechanical connection comprising a right angle bracket member 110 having opposed legs 110*a* and 110*b*, FIG. 13. The bracket member 110 fits in slots formed in the perimeter members 24*c* and 24*d* between the outer and inner walls 38*a* and 40*a* and engages the projections 25, as illustrated in FIG. 14, preferably in snug fitting relationship. Corner bracket member 110 is preferably secured to each of the perimeter members to form a joint therebetween by suitable screw fasteners 111, as illustrated in FIGS. 13 and 14.

Figure 15:
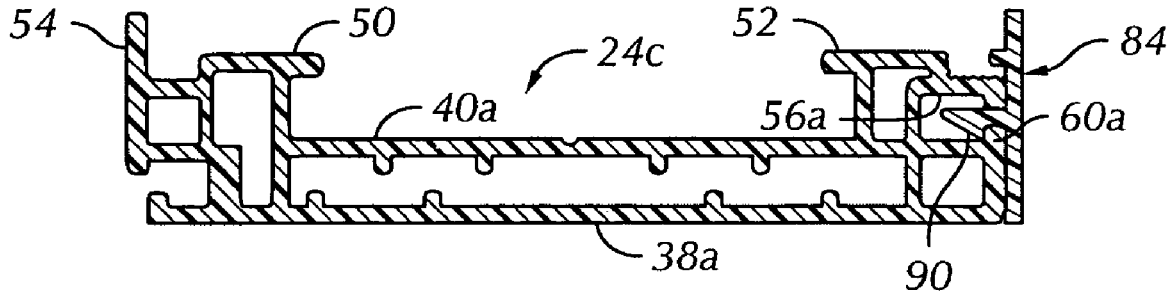
FIG. 15 is a detail transverse section view of a perimeter member showing a retainer member in accordance with the invention connected thereto.

Referring briefly to FIG. 15, there is illustrated the arrangement where the retainer member 84 may be used in conjunction with the perimeter member 24*c* by snapping the hook part 90 into the recess 56*a* whereby the hook part is retained in the recess by engagement with the reentrant edge 60*a* in the same manner that the retainer member 84 may be used in conjunction with the perimeter member 24*b* and 24*d*, as shown in FIGS. 5 and 14, in particular.

Figure 18:
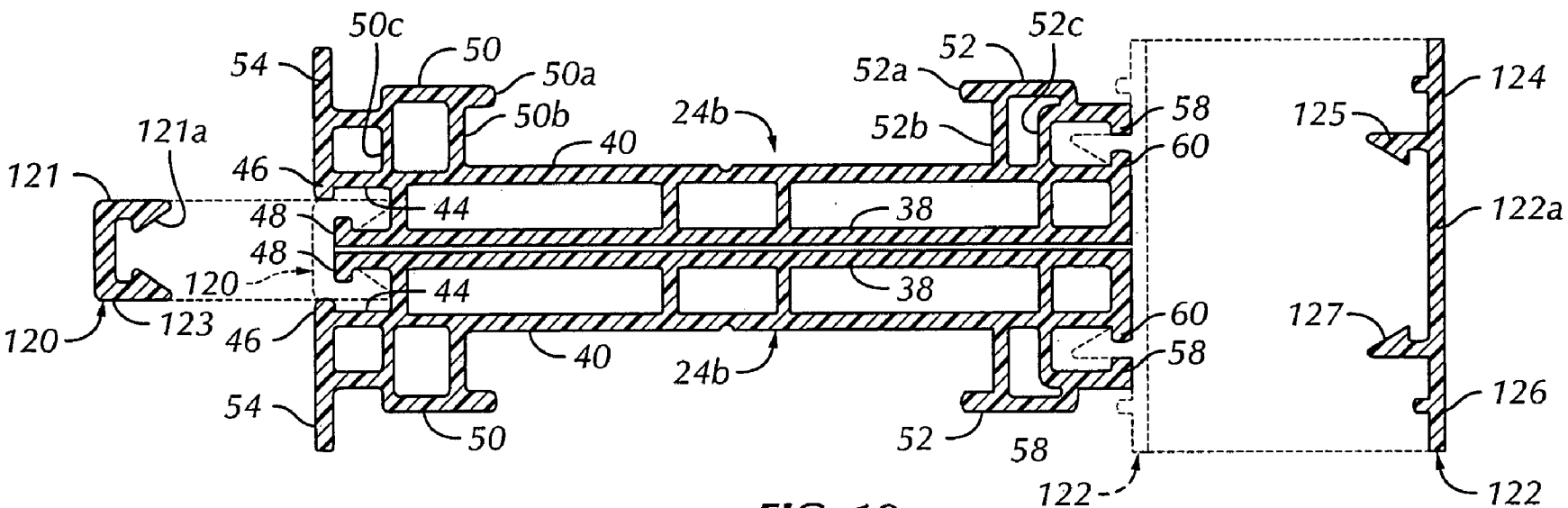
FIG. 18 is a transverse section view illustrating connector members for connecting perimeter members together when multiple glass block frames are secured to each other side by side.

Referring now to FIG. 18, there is illustrated a detail view showing how two or more glass block frames in accordance with the invention may be connected or mullioned to form a larger glass block window or wall. For example, multiple perimeter frames using perimeter members 24*b* may be fastened together as shown in FIG. 18 by respective retainers or connectors 120 and 122. Connector 120 comprises a somewhat channel shaped member having opposed flanges 121 and 123 with respective distal hook parts 121*a* and 123*a* which are operable to project into recesses 44 and engage the respective reentrant edges 48 of the respective abutted perimeters members 24*b*, as illustrated. The opposite sides of the respective perimeter members 24*b*, which are joined, may be done so by the connector and perimeter retainer member 122 which compromises a generally planar plate member 122*a* forming opposed glass block retainer flanges 124 and 126. Hook parts 125 and 127 project from and normal to plate part 122*a* and are engageable with respective reentrant edges 60, as shown, of respective perimeter members 24*b*. The connector and retainer members 120 and 122 may each have a length sufficient to be coextensive with the length of the respective perimeter member 24*b* in order to provide a finished look to the perimeter members and to provide suitable retention of the glass blocks which are retainable within each of frames formed by the perimeter members 24*b*, in the manner previously described.

The construction of a glass block window or wall using the frame members described hereinbefore is believed to be readily understandable and obtainable by one of ordinary skill in the art based on the foregoing description when read in conjunction with the drawings. Conventional engineering plastics may be used to fabricate all of the members of a frame for a glass block window or wall, as described herein, except, of course, for the sealant 55, the corner connector plates 110 and the fasteners 111. Vinyl plastic materials may be used for fabricating the members of the glass block frame of the invention, for example. Other plastic materials having similar properties may be used. Advantageously, substantially all of the plastic members for the glass block frame described herein may be fabricated by extrusion processes.

Preferred embodiments of a glass block frame for providing windows or walls of glass blocks have been described herein. Those skilled in the art will also appreciate that various substitutions and modifications may be made without departing from the scope and spirit of the appended claims.

What is claimed is:

1. A frame for forming a window or wall of a grid of glass blocks arranged side by side in rows and columns, comprising:

a perimeter formed of plural perimeter members interconnected at corners of said frame, said perimeter members each including an outer wall, an inner wall and spaced apart block support surfaces;

plural spacer members adapted to form a rectangular grid for supporting said glass blocks adjacent one another in said grid, said spacer members each including opposed glass block support parts and at least one end for engaging a retainer member; and at least one removable perimeter retainer member releasably connected to respective ones of said perimeter members and including a flange for retaining at least selected ones of said glass blocks in said frame.

2. The frame set forth in claim 1 wherein:

said perimeter members include a block retainer flange formed adjacent one of said support surfaces.

3. The frame set forth in claim 1 wherein:

said perimeter retainer member comprises a hook part projecting away from said flange of said perimeter retainer member and engageable with a reentrant edge formed on and delimiting a recess in said perimeter member.

4. The frame set forth in claim 3 wherein:

said perimeter retainer member includes a sill extension projecting laterally from said frame.

5. The frame set forth in claim 1 wherein:

said flange of said perimeter retainer members is substantially coextensive with said outer wall of said perimeter members, respectively.

6. The frame set forth in claim 1 wherein:

said block support surfaces are formed standing off from said inner wall of said perimeter member to provide a space for receiving one or more fasteners engageable with said inner wall.

7. The frame set forth in claim 1 wherein:

said perimeter members include spaced apart webs interconnecting said inner wall and said outer wall.

8. The frame set forth in claim 7 wherein:

said webs are spaced apart sufficient to receive a corner connector member for connecting two perimeter members together at a right angle corner, said corner connector member comprising a right angle member being insertable in a space formed between said inner wall and said outer wall and said spaced apart webs of adjacent perimeter members, respectively.

9. The frame set forth in claim 1 wherein:

said spacer members include opposed channel shaped portions in said opposed support parts for receiving a rib formed on a glass block supported by said spacer members, respectively.

10. The frame set forth in claim 9 wherein:

said opposed support parts of said spacer members are elastically deflectable toward each other to forcibly engage glass blocks, respectively.

11. The frame set forth in claim 1 wherein:

said perimeter members include opposed lateral flange portions projecting toward each other and said spacer members include opposed longitudinal end parts with opposed slots formed therein for registration with said lateral flange portions to locate and retain said spacer members in pre-selected positions on said frame.

12. The frame set forth in claim 1 wherein:

at least one longitudinal end of selected ones of said spacer members is contoured to engage a wall part of an adjacent spacer member extending at a right angle thereto.

13. The frame set forth in claim 1 wherein:

said spacer members include opposed extension parts having distal entrant edges thereon for receiving a retainer member having a flange, a shank extending at right angles to said flange and a head part forcibly engageable with said reentrant edges formed on said spacer members, respectively.

14. The frame set forth in claim 1 wherein:

adjacent ones of said perimeter members are joined to each other at mitered ends by an angle shaped connector member insertable in slots formed between said inner walls and said outer walls of said adjacent perimeter members, said connector members being secured to said perimeter members, respectively, by mechanical fasteners extending through at least one of said walls of said adjacent perimeter members and in forcible engagement with said connector member.

15. The frame set forth in claim 1 including:

a sealant recess formed on and along at least one side of said perimeter members by a block retaining flange, respectively, said sealant recess being operable for receiving a sealant between said perimeter members and one or more glass blocks.

16. The frame set forth in claim 15 wherein:

sealant support surfaces of said perimeter member delimit said sealant recess and said sealant support surfaces are serrated to enhance adhesion of sealant to said perimeter members.

17. The frame set forth in claim 1 wherein:

recesses are formed on opposite lateral sides of said perimeter members and are delimited, respectively, by at least one reentrant edge engageable with a connector member, and said frame includes opposed connector members including hook parts, respectively, registrable in said recesses, respectively, for securing perimeter members of adjacent frames together.

18. The frame set forth in claim 1 wherein:

at least selected ones of said perimeter members include a flange extending normal to said outer wall and engageable with a surface of a wall in which said frame may be disposed.

19. A frame for forming a window or wall of a grid of glass blocks arranged side by side in rows and columns, comprising:

a perimeter formed of at least four perimeter members interconnected at four corners of said frame, said perimeter members each including an outer wall, an inner wall spaced from said outer wall, spaced apart block support surfaces, a block retainer flange formed adjacent one of said support surfaces and at least one recess delimited by at least one reentrant edge and formed on at least one side of each of said perimeter members;

plural spacer members adapted to form a rectangular grid for supporting glass blocks adjacent one another in said grid, said spacer members each including opposed glass block support parts and opposed ends, at least one of said opposed ends adapted for engaging glass block retainer members; respectively; and perimeter retainer members removably connected to each perimeter member at said one side, said perimeter retainer members each including a flange for retaining at least selected ones of said glass blocks in said frame.

20. The frame set forth in claim 19 wherein:

said perimeter retainer members each include a hook part engageable with said reentrant edge delimiting said recess.

21. The frame set forth in claim 20 wherein:

selected ones of said perimeter retainer members include a sill extension projecting laterally from said frame.

22. The frame set forth in claim 19 wherein:

said inner and outer walls are interconnected by webs spaced apart sufficient to receive a corner connector member for connecting two perimeter members together at a right angle corner, said corner connector member being insertable in a space formed between said inner wall and said outer wall and said spaced apart webs of adjacent perimeter members, respectively.

23. The frame set forth in claim 19 wherein:

said spacer members include opposed channel shaped portions in said opposed support parts for receiving a rib formed on a glass block supported by said spacer members, respectively, and said opposed support parts of said spacer members are elastically deflectable toward each other to forcibly engage glass blocks, respectively.

24. The frame set forth in claim 19 wherein:

said perimeter members include opposed lateral flange portions and at least selected ones of said spacer members include longitudinal end parts with opposed slots formed therein for registration with said lateral flange portions to retain said spacer members in preselected positions in said frame.

* * * * *